US010094074B2

(12) United States Patent
Cawthern

(10) Patent No.: US 10,094,074 B2
(45) Date of Patent: Oct. 9, 2018

(54) MACHINE, SYSTEM AND METHOD FOR RESURFACING EXISTING ROADS

(71) Applicant: The Gorman Group, LLC, Albany, NY (US)

(72) Inventor: John D. Cawthern, Sharon, NH (US)

(73) Assignee: The Gorman Group LLC, Albany, NY (US)

( * ) Notice: Subject to any disclaimer, the term of this patent is extended or adjusted under 35 U.S.C. 154(b) by 0 days.

(21) Appl. No.: 15/885,985

(22) Filed: Feb. 1, 2018

(65) Prior Publication Data

US 2018/0155880 A1 Jun. 7, 2018

Related U.S. Application Data

(63) Continuation of application No. PCT/US2017/023198, filed on Mar. 20, 2017.
(Continued)

(51) Int. Cl.
*E01C 7/00* (2006.01)
*E01C 11/00* (2006.01)
(Continued)

(52) U.S. Cl.
CPC ..... *E01C 11/005* (2013.01); *E01C 7/187* (2013.01); *E01C 7/262* (2013.01); *E01C 7/325* (2013.01);
(Continued)

(58) Field of Classification Search
CPC ..... E01C 7/187; E01C 7/262; E01C 7/325; E01C 11/005; E01C 19/176; E01C 2201/10
(Continued)

(56) References Cited

U.S. PATENT DOCUMENTS 5,069,578 A 12/1991 Bense et al.
5,518,544 A 5/1996 Higginson
(Continued)

FOREIGN PATENT DOCUMENTS

DE 102010026744 A1 1/2012
EP 0360695 A1 3/1990
(Continued)

OTHER PUBLICATIONS

Ge, Zhesheng et al.; "Glass fiber reinforced asphalt membrane for interlayer bonding between asphalt overlay and concrete pavement"; Elsevier; Construction and Building Materials; 101; Copyright Elsevier Ltd.; 2015; pp. 918-925.
(Continued)

*Primary Examiner* — Raymond W Addie
(74) *Attorney, Agent, or Firm* — Hoffman Warnick LLC

(57) ABSTRACT

A machine for resurface existing roads. The machine may include a first group of sprayers configured to form a first layer of binding material, and a fiber material distribution component positioned adjacent the first group of sprayers. The fiber material distribution component may be configured to distribute fiber material onto the first layer of the binding material. The machine may also include a second group of sprayers positioned adjacent the fiber material distribution component. The second group of sprayers may be configured to form a second layer of the binding material over the distributed fiber material. Additionally, the machine may include a channel positioned adjacent the second group of sprayers. The channel may be configured to supply an asphalt mixture over the second layer of the binding material. Further, the machine may include a screed positioned adjacent the conduit. The screed may be positioned to contact the asphalt mixture.

20 Claims, 12 Drawing Sheets

Related U.S. Application Data

(60) Provisional application No. 62/310,067, filed on Mar. 18, 2016.

(51) Int. Cl.
*E01C 7/18* (2006.01)
*E01C 7/32* (2006.01)
*E01C 19/17* (2006.01)
*E01C 7/26* (2006.01)

(52) U.S. Cl.
CPC ..... *E01C 19/176* (2013.01); *E01C 2201/10* (2013.01)

(58) Field of Classification Search
USPC ..... 404/84.05, 101, 111, 118
See application file for complete search history.

(56) References Cited

U.S. PATENT DOCUMENTS

| | | | | |
|---|---|---|---|---|
| 5,735,634 | A * | 4/1998 | Ulrich | E01C 19/48 404/102 |
| 5,769,567 | A | 6/1998 | Durand et al. | |
| 5,895,173 | A * | 4/1999 | O'Brien | E01C 19/21 404/108 |
| 7,448,826 | B2 | 11/2008 | Laury | |
| 7,798,744 | B2 * | 9/2010 | Larson | E01C 19/21 404/101 |
| 7,802,941 | B2 | 9/2010 | Wingo et al. | |
| 2016/0160453 | A1 * | 6/2016 | Donelson | E01C 7/187 404/75 |

FOREIGN PATENT DOCUMENTS

| | | | |
|---|---|---|---|
| EP | 0456502 | A2 | 11/1991 |
| FR | 2611766 | A1 | 9/1988 |
| FR | 2661929 | A1 | 11/1991 |
| FR | 2721953 | A1 | 1/1996 |

OTHER PUBLICATIONS

Rogers, Dennis; "How Best to Protect Asphalt Overlays with Interlayers—Delay Deterioration and Extend Pavement Life"; APWA 2015; Nov. 18, 2015; pp. 72.

Wargo, Andrew et al.; "Comparing the Performance of Fiberglass Grid with Composite Interlayer Systems in Asphalt Concrete"; Transportation Research Record: Journal of the Transportation Research Board; No. 2631; 2017; pp. 123-132.

International Search Report and Written Opinion dated Jun. 20, 2017 for PCT Application PCT/US2017/023198 filed Mar. 20, 2017; pp. 14.

Lytton, Robert, et al.; "TRB Webinar: Development and Implementation of the Reflective Cracking Model in the Mechanistic-Empirical Pavement Design Guide"; NCHRP—National Cooperative Highway Research Program; Aug. 17, 2016; pp. 2.

Elseifi, Mostafa et al.; "TRB Webinar: Mechanisms and Mitigation Strategies for Reflective Crackling in Rehabilitated Pavements"; The National Academies of Sciences Engineering Medicine; Transportation Research Board; Aug. 24, 2015; pp. 2.

Brown, Steven; "Fibre-Reinforced Seals"; Austroads Technicial Report; First Published 2005; Copyright 2005 Austroads Inc.; Austroads Publication No. AP-T35/05; pp. 19.

* cited by examiner

MACHINE, SYSTEM AND METHOD FOR RESURFACING EXISTING ROADS

TECHNICAL FIELD

The disclosure relates generally to road resurfacing machines and systems, and more particularly to machines and systems designed to resurface and repair an existing road having defects by forming stress absorbing membrane interlayers (SAMIs) over the existing road, and asphalt mixtures directly over the SAMIs.

BACKGROUND

Improved materials and paving processes continue to increase the strength and durability of paved surfaces. This in turn has increased the operational/drivable life of these roads for personal and commercial drivers. However, a number of factors continue to negatively impact paved surfaces. These factors include irregularities in materials, irregularities in processes during paving, irregularities in the existing road being paved, ambient weather and the like. These factors typically result in surface defects in the road such as cracks, unevenness, potholes and/or surface crumbling. These surface defects can reduce the strength and/or operational/drivable life of the paved surface. With reduced strength and operational/drivable life, the roads can require constant upkeep and maintenance, and eventually require total replacement and/or resurfacing. This maintenance and/or road replacement can be costly and often requires the road to be at least partially shut down during repair and replacement.

One maintenance process commonly used to prolong the operational/drivable life of a road with surface defects is to fill the surface defects with filling material (e.g., flexible material, asphalt patches and so on). However, simply filling the surface defects often is a temporary fix and does not prevent surface defects from forming in other areas of the road. Filling defects may not necessarily prevent the filled surface defects from spreading and/or growing as well. Another common maintenance solution is to provide an additional layer or topcoat over the existing road including surface defects. While the additional layer or topcoat may be initially free from surface defects, the existing surface defects in the cover road surface may grow and/or may penetrate through the topcoat, causing new surface defects to form within the topcoat. This is often referred to, or known as "reflective cracking."

Another conventional maintenance solution that helps to increase the operational/drivable life of the road and prevent reflective cracking is the use of paving fabric interlayers. Paving fabrics are often formed from a length of flexible sheet material that is rolled onto a spool. The paving fabrics are unrolled directly onto a tack layer that is deposited directly on the road including the surface defects. The paving fabrics are adhered to the existing road via the tack layer, and then subsequently covered by depositing hot mix asphalt directly on and/or over the paving fabrics. The flexible characteristics of the paving fabric interlayer can prevent surface defects from forming in the hot mix asphalt layer and substantially mitigate reflective cracking within the hot mix asphalt layer.

While the paving fabrics can mitigate and/or reduce the risk of reflective cracking in the hot mix asphalt layer, the process for laying and/or utilizing the paving fabrics presents additional issues that may negatively affect the strength, quality and operational/drivable life of the road. For example, the paving fabric must be laid flat over the tack layer almost immediately after that tack layer is deposited. If too much time passes between depositing the tack layer and rolling the paving fabrics over the tack layer, and/or if the paving fabric is rippled, bumpy and/or is not laid substantially flat over the tack layer, bonding issues between the tack layer and the paving fabrics may arise. These bonding issues can cause weakened areas in the road, which may lead to premature failure and/or increased risk of surface defects. Additionally, where a gap is formed between the paving fabrics and tack layer due to a ripple or bump in the paving fabric, the paving fabric interlayer may be capable of moving or sliding, even after the hot mix asphalt is deposited over the paving fabric. The ability of the paving fabric to move or slide may cause and/or impart a high, undesirable stress on the hot mix asphalt after it has cooled, hardened and/or cured over the paving fabric. This may ultimately result in surface defects forming in the area of the hot mix asphalt layer that experience this undesirable stress.

SUMMARY

Generally, embodiments discussed herein are related to machines, systems and methods for resurfacing an existing road having defects. A system includes a machine and a fiber material storage that are configured to resurface an existing road that includes surface defects. A machine includes a first and second group of sprayers that spray and/or form distinct layers of binding material over the existing road. Positioned between the first and second group of sprayers may be a fiber material distribution component that disposes fiber material, provided by the fiber material storage, over the existing road and between the two distinct layers of binding material. Specifically, the fiber material disposed over the existing road may be embedded, sandwiched and/or secured between a first layer of binding material formed by the first group of sprayers, and a second layer of binding material formed by the second group of sprayers. These three layers may be referred to as stress absorbing membrane interlayers (SAMIs), which may fill and/or seal surface defects formed in the existing road, as well as provide strength and flexibility to the resurfaced road to mitigate and/or prevent reflective cracking in the layers of material deposited over the SAMIs. Downstream from the second group of sprayers may be a channel for supplying an asphalt mixture directly over the SAMIs (e.g., first layer of binding material, fiber material, second layer of binding material). The asphalt mixture may be shaped using a screed positioned adjacent the channel to form a top layer that may be driven on by a user of the resurfaced road. The asphalt mixture forming the top layer of the resurfaced road may be adhered and/or bonded directly to the SAMIs, and has an increased operational/drivable life because of the SAMIs, the strength and flexible characteristics associated with the SAMIs, and the ability of the SAMIs to mitigate and/or prevent reflective cracking.

One embodiment includes a machine having a first group of sprayers configured to form a first layer of binding material, and a fiber material distribution component positioned adjacent the first group of sprayers. The fiber material distribution component may be configured to distribute fiber material onto the first layer of the binding material. The machine may also have a second group of sprayers positioned adjacent the fiber material distribution component. The second group of sprayers may be configured to form a second layer of the binding material over the distributed fiber material. Additionally, the machine may include a channel positioned adjacent the second group of sprayers, where the channel may be positioned to supply an asphalt mixture over the second layer of the binding material, and a screed positioned adjacent the conduit. The screed may contact the asphalt mixture.

Another embodiment includes a system having a machine. The machine may include a first group of sprayers configured to form a first layer of binding material, and a fiber material distribution component positioned adjacent the first group of sprayers, where the fiber material distribution component may be configured to distribute fiber material onto the first layer of the binding material. The machine may also include a second group of sprayers positioned adjacent the fiber material distribution component. The second group of sprayers may be configured to form a second layer of the binding material over the distributed fiber material. Additionally, the machine may include a channel positioned adjacent the second group of sprayers, where the channel may supply an asphalt mixture over the second layer of the binding material and a screed positioned adjacent the conduit. The screed may contact the asphalt mixture. The system may also include a fiber material storage coupled to the machine. The fiber material storage may store the fiber material distributed by the fiber material distribution component. Additionally, the system may also include a control system in electrical communication with the machine and the fiber material storage. The control system may be configured to control the distribution of: the binding material sprayed by the first group of sprayers, the fiber material distributed by the fiber distribution component, the binding material sprayed by the second group of sprayers, the asphalt mixture supplied by the channel, and/or the fiber material provided from the fiber material storage to the fiber material distribution component.

A further embodiment includes a method of resurfacing an exposed surface of an existing road. The method includes covering the exposed surface with a first layer of a binding material, disposing a fiber material at least partially over the first layer of the binding material and covering the fiber material with a second layer of the binding material. The method may also include disposing an asphalt mixture directly over the second layer of the binding material, and shaping the asphalt mixture disposed over the second layer of the binding material.

An additional embodiment includes a resurfaced road having a first layer of a binding material covering an exposed surface of an existing road, a collection of fiber material disposed over the first layer of the binding material, a second layer of the binding material covering the collection of the fiber material. The second layer of the binding material may secure the collection of the fiber material between the first layer of the binding material and the second layer of the binding material. The resurfaced road may also include an asphalt mixture positioned directly on and covering the second layer of the binding material.

BRIEF DESCRIPTION OF THE DRAWINGS

The disclosure will be readily understood by the following detailed description in conjunction with the accompanying drawings, wherein like reference numerals designate like structural elements, and in which.

Figure 1A:
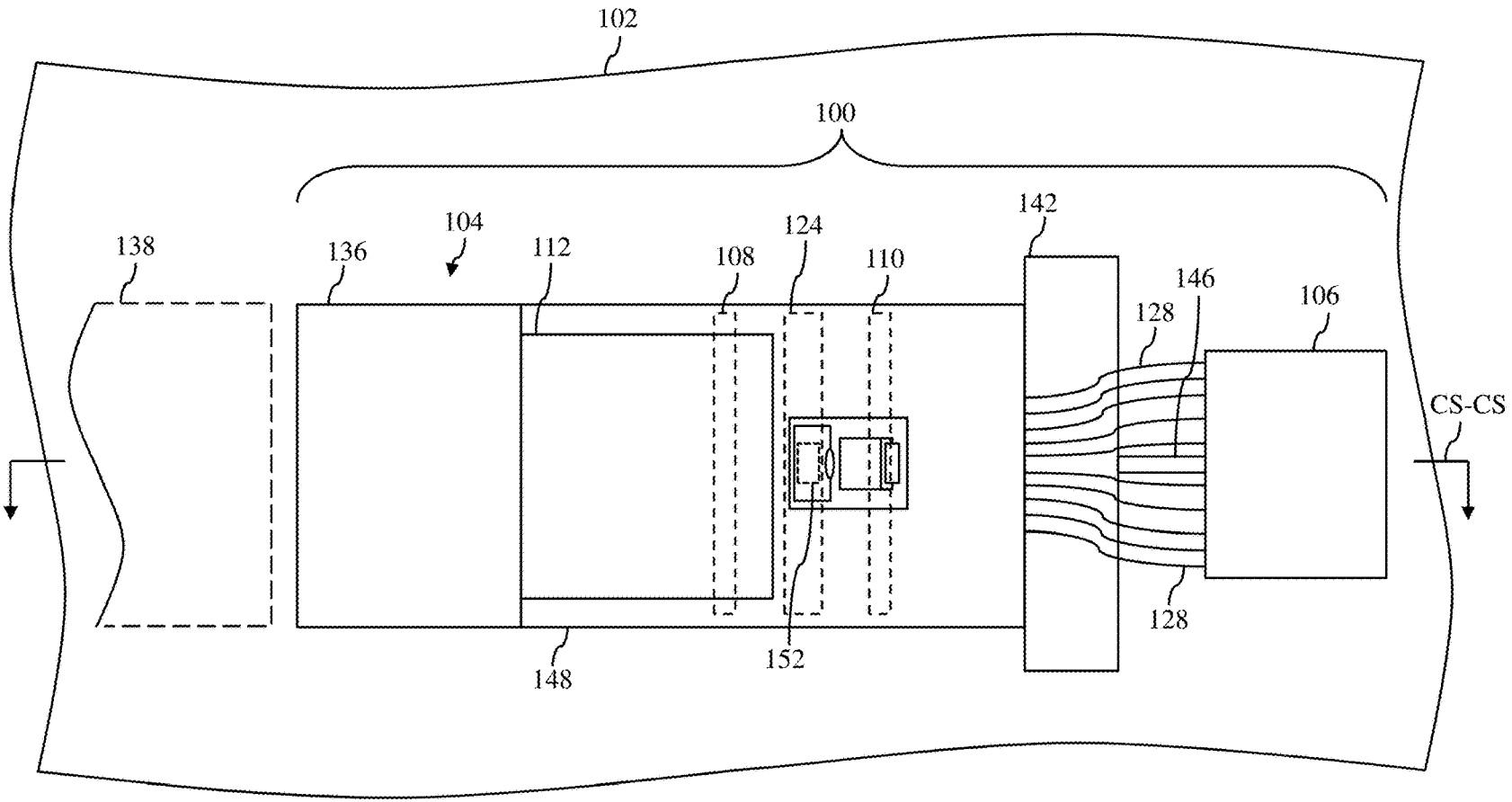
FIG. 1A depicts a schematic top view of a road resurfacing system including a road resurfacing machine, a fiber material storage, a control system and an asphalt supply component, according to embodiments.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates generally to a road resurfacing machine and system, and more particularly to a machine and system designed to resurface and repair an existing road having defects by forming stress absorbing membrane interlayers (SAMIs) over the existing road, and asphalt mixtures directly over the SAMIs.

Generally, embodiments discussed herein are related to a machine, a system and a method for resurfacing an existing road having defects. The system includes a machine and a fiber material storage that are configured to resurface an existing road that includes surface defects. The machine includes a first and second group of sprayers that spray and/or form distinct layers of binding material over the existing road. Positioned between the first and second group of sprayers may be a fiber material distribution component that disposes fiber material, provided by the fiber material storage, over the existing road and between the two distinct layers of binding material. Specifically, the fiber material disposed over the existing road may be embedded, sandwiched and/or secured between a first layer of binding material formed by the first group of sprayers, and a second layer of binding material formed by the second group of sprayers. These three layers may be referred to as stress absorbing membrane interlayers (SAMIs), which may fill and/or seal surface defects formed in the existing road, as well as provide strength and flexibility to the resurfaced road to mitigate and/or prevent reflective cracking in the layers of material deposited over the SAMIs. Downstream from the second group of sprayers may be a channel for supplying an asphalt mixture directly over the SAMIs (e.g., first layer of binding material, fiber material, second layer of binding material). The asphalt mixture may be shaped using a screed positioned adjacent the channel to form a top layer that may be driven on by a user of the resurfaced road. The asphalt mixture forming the top layer of the resurfaced road may be adhered and/or bonded directly to the SAMIs, and has an increased operational/drivable life because of the SAMIs, the strength and flexible characteristics associated with the SAMIs, and the ability of the SAMIs to mitigate and/or prevent reflective cracking.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely illustrative.

These and other embodiments are discussed below with reference to FIGS. 1-6E. However, those skilled in the art will readily appreciate that the detailed description given herein with respect to these Figures is for explanatory purposes only and should not be construed as limiting.

Figure 1B:
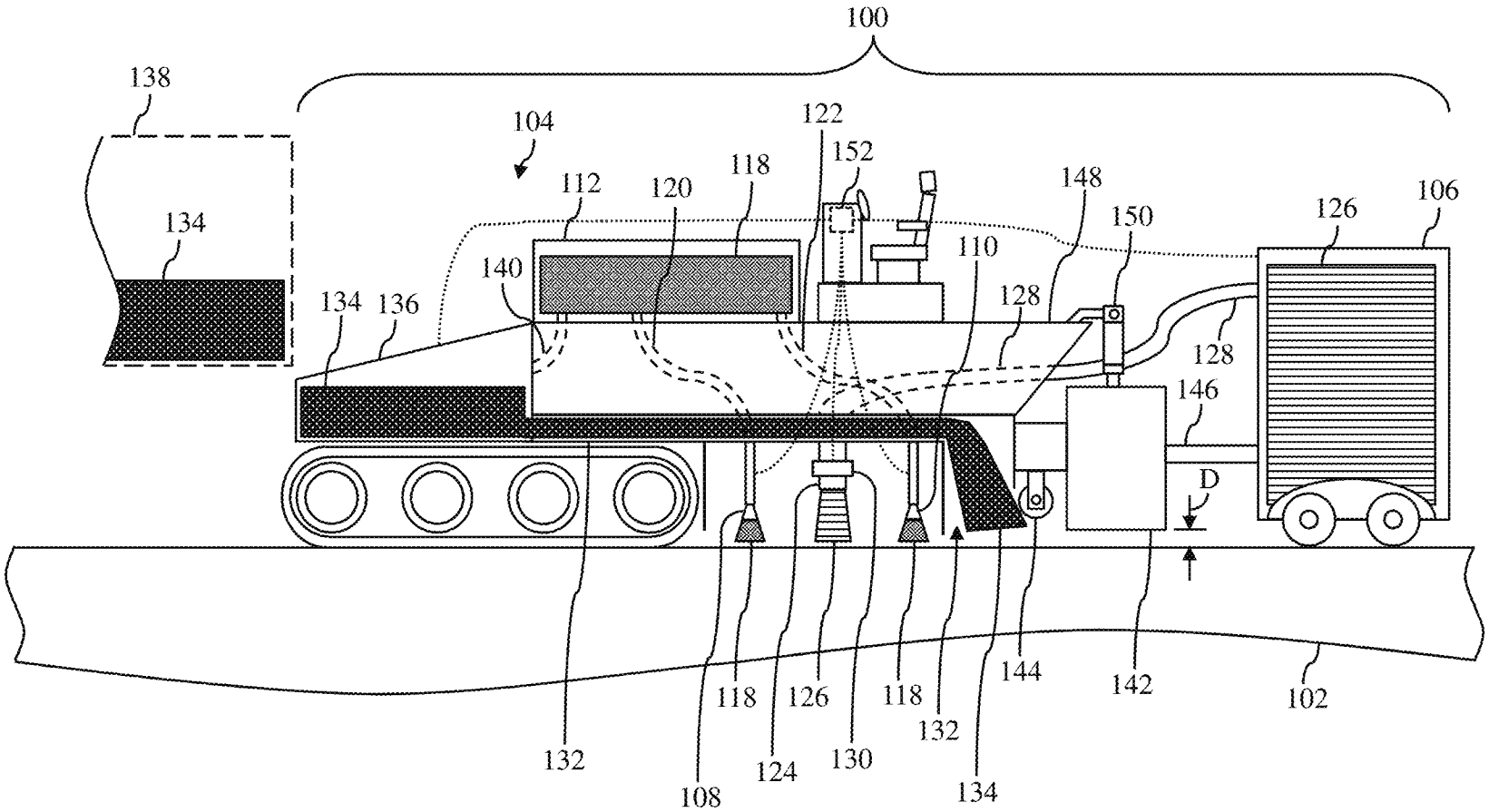
FIG. 1B depicts a schematic cross-sectional side view of the road resurfacing system of FIG. 1A taken along line CS-CS, according to embodiments.

FIGS. 1A and 1B show a road resurfacing system 100, according to embodiments. Specifically, FIG. 1A shows a schematic top view of road resurfacing system 100, and FIG. 1B shows a side cross-sectional view of road resurfacing system 100 taken along line CS-CS in FIG. 1A. As discussed herein, road resurfacing system 100 may be configured to and/or capable of resurfacing an existing road 102 in a single pass over the existing road 102, while eliminating an intermediate aggregate layer and reducing the risk of reflective cracking in the resurfaced road.

Road resurfacing system 100 (hereafter, "system 100") may include a road resurfacing machine 104 (hereafter, "machine 104") and a fiber material storage 106 coupled to machine 104. As discussed in detail herein, machine 104 of system 100 includes various components configured to substantially provide, create and/or form stress absorbing membrane interlayers (SAMIs) over existing road 102, as well as substantially provide, create and/or form a surface layer of material over existing road 102 and the SAMIs. Additionally, as discussed herein, fiber material storage 106 coupled to machine 104 may be towed and/or moves with machine 104 to supply fiber material used to form at least one layer of the SAMIs formed over existing road 102 using system 100.

As shown in FIGS. 1A and 1B, machine 104 may include a first group of sprayers 108 (shown in phantom in FIG. 1A). First group of sprayers 108 may be positioned on, fixed and/or coupled to an underside and/or undercarriage of machine 104 (see, FIG. 1B). Additionally, and as shown in FIG. 1B, first group of sprayers 108 may be positioned substantially adjacent to and/or above existing road 102. In a non-limiting example shown in FIG. 1A, first group of sprayers 108 may span and/or extend over substantially the entire width of machine 104. In another non-limiting example, first group of sprayers 108 may span or extend over only a portion of the width of machine 104. In a further non-limiting example, first group of sprayers 108 may span or extend beyond the width of machine 104, such that a portion first group of sprayers 108 may be positioned outside of machine 104.

First group of sprayers 108 may include any suitable sprayer, nozzle and/or dispensing component that may dispense a substantially liquid-material onto existing road 102. As discussed herein, first group of sprayers 108 may be configured to dispense, spray and/or cover existing road 102 with a substantially liquid binding material to form a first layer of binding material on existing road 102. Although a single bar is shown in FIG. 1A, and a single sprayer or nozzle is depicted in FIG. 1B, it is understood that first group of sprayers 108 of machine 104 may include a plurality of individual sprayers or nozzles coupled to, supported by and/or position linearly on a support structure (e.g., bar, rail and so on) for spraying a binding material onto existing road 102, as discussed herein.

Machine 104 may also include a second group of sprayers 110 (shown in phantom in FIG. 1A) positioned proximate to first group of sprayers 108. Specifically, and as shown in FIGS. 1A and 1B, second group of sprayers 110 may be positioned proximate to and substantially downstream from first group of sprayers 108. Similar to first group of sprayers 108, second group of sprayers 110 may be positioned on, fixed and/or coupled to an underside and/or undercarriage of machine 104 (see, FIG. 1B), and may be positioned substantially adjacent to and/or above existing road 102. In a non-limiting example shown in FIG. 1A, second group of sprayers 110 may span and/or extend over substantially the entire width of machine 104. In other non-limiting examples, second group of sprayers 110 may span or extend over only a portion of the width of machine 104, or alternatively, may span or extend beyond the width of machine 104.

Although shown to be substantially similar in length, it is understood that first group of sprayers 108 and second group of sprayers 110 may extend over distinct distances of the width of machine 104. That is, in a non-limiting example shown in FIG. 1A, first group of sprayers 108 and second group of sprayers 110 may be substantially aligned and may each extend over substantially the entire width of machine 104. In other non-limiting examples, first group of sprayers 108 may extend over more or less of the width of machine 104 than second group of sprayers 110.

Similar to first group of sprayers 108, second group of sprayers 110 may include any suitable sprayer, nozzle and/or dispensing component that may dispense a substantially liquid-material onto existing road 102. As discussed herein, second group of sprayers 110 may be configured to dispense, spray and/or cover the first layer of binding material dispensed by first group of sprayers 108 and fiber material with a substantially-liquid binding material to form a second layer of binding material over existing road 102. Although a single bar is shown in FIG. 1A, and a single sprayer or nozzle is depicted in FIG. 1B, it is understood that second group of sprayers 110 of machine 104 may include a plurality of individual sprayers or nozzles coupled to, supported by and/or position linearly on a support structure (e.g., bar, rail and so on) for spraying a binding material onto existing road 102, as discussed herein.

As shown in FIGS. 1A and 1B, machine 104 may also include binding material storage 112. Binding material storage 112 may be positioned on, coupled to and/or may be formed integrally with machine 104, such that binding material storage 112 moves with machine 104 during the road resurfacing process discussed herein. Binding material storage 112 may hold, store and/or contain a supply of binding material 118 (see, FIG. 1B) that may be utilized in the road resurfacing process. In non-limiting examples, binding material storage 112 may be formed from any suitable container, bin, tank, receptacle and/or vessel capable of storing binding material 118.

Binding material storage 112 may be in fluid communication with first group of sprayers 108 and second group of sprayers 110, respectively. More specifically, binding material storage 112 may be in fluid communication with first group of sprayers 108 and second group of sprayers 110, respectively, via supply conduits. In non-limiting examples shown in FIG. 1B, machine 104 may include a first conduit 120 coupled to binding material storage 112 and first group of sprayers 108, and a second conduit 122 coupled to binding material storage 112 and second group of sprayers 110. In another non-limiting example (not shown), first conduit 120 and second conduit 122 may be partially formed from a single conduit and share a single outlet from binding material storage 112. In this non-limiting example, first conduit 120 and second conduit 122 may separate and/or form two distinct conduits downstream of binding material storage 112 to supply binding material 118 to first group of sprayers 108 and second group of sprayers 110 independently. First conduit 120 may carry, flow and/or move binding material 118 in binding material storage 112 to first group of sprayers 108, and second conduit 122 may carry, flow and/or move binding material 118 in binding material storage 112 to first group of sprayers 108. As discussed herein, first group of sprayers 108 and second group of sprayers 110 may dispense binding material 118 supplied by conduits 120, 122 onto existing road 102 during a road resurfacing process. First conduit 120 and second conduit 122 may be any suitable conduit, pipe, hose and/or other channel for moving and/or flowing binding material 118 from binding material storage 112 to first group of sprayers 108 and/or second group of sprayers 110, respectively.

As shown in FIGS. 1A and 1B, machine 104 may also include a fiber material distribution component 124 (shown in phantom in FIG. 1A). Fiber material distribution component 124 may be positioned adjacent first group of sprayers 108, and more specifically, may be positioned between first group of sprayers 108 and second group of sprayers 110. As such, fiber material distribution component 124 may substantially separate second group of sprayers 110 from first group of sprayers 108 in machine 104. Similar to sprayers 108, 110 of machine 104, fiber material distribution component 124 may be positioned on, fixed and/or coupled to an underside and/or undercarriage of machine 104 (see, FIG. 1B). Additionally, and as shown in FIG. 1B, fiber material distribution component 124 may be positioned substantially adjacent to and/or above existing road 102. In a non-limiting example shown in FIG. 1A, fiber material distribution component 124 may span and/or extend over substantially the entire width of machine 104. In other non-limiting examples, fiber material distribution component 124 may span or extend over only a portion of the width of machine 104, or alternatively, may span or extend beyond the width of machine 104, such that a portion fiber material distribution component 124 may be positioned outside of machine 104.

As discussed herein, fiber material distribution component 124 may be configured and/or capable of dispensing, disbursing and/or distributing fiber material 126 onto and/or over the first layer of binding material 118 formed on existing road 102 by first group of sprayers 108. As such, fiber material distribution component 124 may include any suitable channel, hose, conduit and/or dispensing component that may dispense fiber material 126 over the first layer of binding material 118 formed on existing road 102 (see, FIG. 4). In a non-limiting example shown in FIG. 1B, fiber material distribution component 124 may be a collection of conduits (only one shown) large enough to allow fiber material 126 to move through conduits and be dispersed over existing road 102. Although a single bar is shown in FIG. 1A, and a single conduit is depicted in FIG. 1B, it is understood that fiber distribution component 124 of machine 104 may include a plurality of individual conduits coupled to, supported by and/or position linearly on a support structure (e.g., bar, rail and so on) and in communication with distinct fiber material supply lines for system 100 for distributing fiber material 126 onto existing road 102, as discussed herein.

Fiber material 126 supplied to fiber material distribution component 124 may be stored in fiber material storage 106 of system 100. More specifically, and as shown in FIG. 1B, fiber material storage 106 may store fiber material 126 that may be supplied to and subsequently distributed by fiber material distribution component 124 over existing road 102. In a non-limiting example and as discussed in detail herein, fiber material 126 may be fiberglass material formed in a spool or spools of fiberglass cordage, fibers and/or strands. The spools of fiberglass forming fiber material 126 are stored within fiber material storage 106 and may be provided and/or supplied to fiber material distribution component 124 via a plurality of supply lines 128, as discussed herein. Fiber material storage 106, as shown in FIGS. 1A and 1B may be any suitable storage container, bin, tank, receptacle and/or vessel configured to store fiber material 126 to be supplied to and distributed by fiber material distribution component 124 on machine 104 of system 100.

System 100 may include a plurality of supply lines 128 coupled to fiber material storage 106. More specifically, and as shown in FIGS. 1A and 1B, the plurality of supply lines 128 (see, FIG. 1A) may be coupled to fiber material storage 106 and fiber material distribution component 124 (see, FIG. 1B). In addition to being coupled to the distinct components in system 100, the plurality of supply lines 128 may also allow fiber material storage 106 to be in communication with fiber material distribution component 124. As a result, and as discussed herein, the plurality of supply lines 128 may supply fiber material 126 stored in fiber material storage 106 to fiber material distribution component 124. The plurality of supply lines 128 may include any suitable channel, hose, conduit and/or dispensing component that may dispense fiber material 126 from fiber material storage 106 to fiber material distribution component 124. As discussed herein, each of the plurality of supply lines 128 may be coupled to an individual and distinct fiber material distribution component 124 of machine 104, such that each supply line 128 provides fiber material 126 to a specific and/or individual fiber material distribution component 124.

Fiber material 126 may be provided, transported and/or supplied to fiber material distribution component 124 via the plurality of supply lines 128 using various supply methods and/or components. In a non-limiting example, fiber material 126 stored in fiber material storage 106 may be feed into supply lines 128 and may be moved through supply lines 128 to fiber material distribution component 124 using a feeder component (not shown) positioned on supply lines 128 and/or fiber material distribution component 124. In the non-limiting example, the feeder component (not shown) may contact, grab, pull and/or push fiber material 126 within the supply lines 128 toward fiber material distribution component 124 to be distributed onto existing road 102. In another non-limiting example discussed herein, other feeder components, such as a blower, may be used to move, force and/or push fiber material 126 through supply lines 128 toward fiber material distribution component 124. In a further non-limiting example, fiber material 126 may move through supply lines 128 to fiber material distribution component 124 using gravity.

Machine 104 of system 100 may also include a cutting device 130. Cutting device 130 may cut fiber material 126 to a predetermined length prior to fiber material 126 being distributed by fiber material distribution component 124. In a non-limiting example shown in FIG. 1B, cutting device 130 may be formed on, in communication with and/or integrally with fiber material distribution component 124. More specifically, cutting device 130 may be formed integrally with fiber material distribution component 124, such that fiber material 126 moving through fiber material distribution component 124 may pass through and be cut to a predetermined length by cutting device 130 prior to fiber material distribution component 124 distributing fiber material 126 over existing road 102. In another non-limiting example (not shown), cutting device 130 may be positioned between supply line 128 and fiber material distribution component 124. Specifically in the non-limiting example (not shown), cutting device 130 may couple supply line 128 to fiber material distribution component 124 and may be configured to cut fiber material 126 to the predetermined length prior to the cut fiber material 126 passing and/or moving to fiber material distribution component 124 to be distributed onto existing road 102.

In the non-limiting example, cutting device 130 may be a collection of blades configured to cut fiber material 126 as it passes through fiber material distribution component 124. In other non-limiting examples, cutting device 130 may be formed as any suitable cutting, chopping, severing, ripping and/or material-separating device configured to cut fiber material 126 to a predetermined length. Additionally, cutting device 130 may also be configured to aid in moving fiber material 126 from fiber material storage 106 to fiber material distribution component 124 and/or through supply lines 128. That is, in addition to cutting fiber material 126, cutting device 130 may also operate in a similar fashion as a feeder component (not shown), as discussed above. In a non-limiting example, cutting device 130 may contact, grab and/or pull fiber material 126 within the supply lines 128 toward cutting device 130 to be cut and subsequently moved to fiber material distribution component 124. The predetermined cut length of the fiber material 124 cut by cutting device 130 may be dependent, at least in part on characteristics relating to the road resurfacing process, as discussed herein.

Machine 104 may also include a channel 132. Channel 132 may be positioned adjacent second group of sprayers 110. More specifically, and as shown in FIG. 1B, a portion of channel 132 may be positioned adjacent and downstream of second group of sprayers 110. The portion of channel 132 positioned adjacent second group of sprayers 110 may be open to and/or positioned above existing road 102. The remaining portion of channel 132 may be formed within machine 104 and may be positioned above and/or over first group of sprayers 108, second group of sprayers 110 and fiber material distribution component 124, respectively. As shown in FIG. 1B, channel 132 may extend over first group of sprayers 108, second group of sprayers 110 and fiber material distribution component 124 and may extend toward existing road 102 to supply an asphalt mixture 134 to existing road 102. That is, and as discussed herein in detail, channel 132 may supply asphalt mixture 134 over a second layer of binding material 118 formed by second group of sprayers 110 of machine 104.

Machine 104 may also include a hopper 136. As shown in FIGS. 1A and 1B, hopper 136 may be positioned on, coupled to and/or may be formed integrally with machine 104, such that hopper 136 moves with machine 104 during the road resurfacing process discussed herein. Hopper 136 may receive and temporarily store and/or hold asphalt mixture 134. In non-limiting examples, hopper 136 may be formed from any suitable container, bin, tank, receptacle and/or vessel capable of storing and/or receiving asphalt mixture 134.

In a non-limiting example, hopper 136 may contain and/or store asphalt mixture 134 to be used in the road resurfacing process performed by machine 104, as discussed herein. In another non-limiting example, hopper 136 may receive asphalt mixture 134 from a supply device 138 (shown in phantom) positioned in front of hopper 136. In the non-limiting example shown in FIG. 1B, supply device 138 may be a portion of an open-box bed for a dump truck containing asphalt emulsion. Supply device 138 may move down existing road 102 with machine 104 during the road resurfacing process discussed herein, and may continuously or intermittently provide, pour and/or dump asphalt mixture 134 into hopper 136 of machine 104. Although discussed herein as a dump truck, it is understood that supply device 138 may be any suitable device or component capable of storing a large quantity of asphalt mixture 134 and configured to provide asphalt mixture 134 to hopper 136.

As shown in FIG. 1B, channel 132 of may be coupled to and/or in communication with hopper 136. More specifically, channel 132 may be in communication with hopper 136 and channel 132 may receive asphalt mixture 134 from hopper 136 for use in the road resurfacing process, as discussed herein. Channel 132 and/or hopper 136 may include components for moving asphalt mixture 134 from hopper 136 to channel 132 and/or moving asphalt mixture 134 through channel 132 to be supplied and/or deposited onto existing road 102. In a non-limiting example, channel 132 and/or hopper 136 may include a screw or auger conveyor. The auger conveyor of hopper 136 may continuously mix asphalt mixture 134 within hopper 136, and may also carry and/or supply asphalt mixture 134 to channel 132. Once in channel 132, the auger conveyor of channel 132 may carry and/or move asphalt mixture 134 downstream from hopper 136 toward the portion of channel 132 open to and/or positioned directly above existing road 102. In the non-limiting example, the auger conveyor of channel 132 may then push and/or deposit asphalt mixture 134 onto existing road 102 with the assistance of gravity. In other non-limiting examples, channel 132 and/or hopper 136 may include a conveyor belt, pneumatic conveyor, vibration conveyor, roller conveyor and/or any other conveyor system, or combination thereof, configured to move asphalt mixture 134 from hopper 136 to channel 132, and subsequently along channel 132 to existing road 102, as discussed herein.

As discussed in detail herein, asphalt mixture 134 may be a mixture of binding material 118 and aggregate (e.g., stone). In a non-limiting example shown in FIG. 1B, the combination of binding material 118 and aggregate forming asphalt mixture 134 may be pre-mixed before being supplied to supply device 138 and/or received by hopper 136. In another non-limiting example, asphalt mixture 134 may be only partially mixed and include a portion of the desired binding material before being stored in supply device 138 and/or received by hopper 136. In this non-limiting example, machine 104 may also include a hose 140 in fluid communication with binding material storage 112 and binding material 118 contained therein, and hopper 136. Hose 140 may supply an amount of binding material 118 to hopper 136 and the partially mixed material forming asphalt mixture 134 received and/or stored in hopper 136. The binding material 118 provided to hopper 136 via hose 140 may be mixed into the partially mixed material of asphalt mixture 134 to form the final asphalt mixture 134 utilized in the road resurfacing process discussed herein. In an additional non-limiting example (not shown), only aggregate material may be supplied and/or received by hopper 136, and hose 140 may supply all binding material 118 that may be required to be mixed with the aggregate in hopper 136 for form asphalt mixture 134. In these non-limiting examples, the conveyor system in hopper 136, as discussed above, may also be used to mix binding material 118 supplied by hose 140 with the materials in hopper 136 to form asphalt mixture 134.

As shown in FIGS. 1A and 1B, machine 104 may also include a screed 142. Screed 142 may be positioned adjacent conduit 132 of machine 104. More specifically, screed 142 may be positioned downstream from conduit 132, and may be coupled to machine 104 directly adjacent conduit 132. As such, conduit 132 may be positioned between second group of sprayers 110 and screed 142. Screed 142 may contact asphalt mixture 134 after asphalt mixture 134 is supplied and/or deposited over existing road 102. More specifically, screed 142 may be positioned above existing road 102, and may contact, press, and/or apply pressure and/or a force to asphalt mixture 134 supplied and/or deposited over existing road 102 via conduit 132. Screed 142 may contact asphalt mixture 134 to substantially shape and/or form asphalt mixture 134 into a substantially compact and substantially flat exposed driving surface during the road resurfacing process discussed herein. Screed 142 may be formed from any suitable tool, device and/or instrument configured to flatten, smooth and/or true asphalt mixture 134 over existing road 102, as discussed herein. In a non-limiting shown in FIG. 1B, screed 142 may be a floating screed.

Asphalt mixture 134 supplied via conduit 132 may also be moved toward existing road 102 and/or screed 142 using a feeder wheel 144, positioned between conduit 132 and screed 142. Feeder wheel 144 may rotate to aid in the movement of asphalt mixture 134 from conduit 132 to existing road 102 and/or screed 142, and may substantially prevent an undesired build-up of asphalt mixture 134 on existing road 102 and/or adjacent screed 142. In non-limiting examples, feeder wheel 144 may be any suitable device or component that may move and/or rotate to aid in the movement of asphalt mixture 134 from conduit 132 to existing road 102.

Screed 142 may aid in the coupling of fiber material storage 106 to machine 104 as well. In a non-limiting example, fiber material storage 106 may be coupled to screed 142 via a coupling bar 146. In the non-limiting example, as machine 104 including screed 142 moves along existing road 102 during the road resurfacing process, fiber material storage 106 may be pulled and/or move with machine 104 as a result of coupling bar 146 coupling fiber material storage 106 to screed 142. Although fiber material storage 106 is shown in FIGS. 1A and 1B to be coupled to screed 142 via coupling bar 146, it is understood that coupling bar 144 may be coupled to other portions of machine 104. In another non-limiting example, coupling bar 146 may be coupled directly to machine body 148 in order to couple fiber material storage 106 to machine 104 and ensure fiber material storage 106 moves with machine 104 during the road resurfacing process discussed herein.

Although shown as being coupled to screed 142 and towed or pulled behind machine 104, it is understood that fiber material storage 106 may be positioned in various portions of system 100 during the road resurfacing process discussed herein. In a non-limiting example (not shown), fiber material storage 106 may be positioned in front of machine 104 and/or adjacent hopper 136 during the road resurfacing process. In the non-limiting example fiber material storage 106 may be positioned between machine 104 and supply device 138, or alternatively, may be positioned in front of both machine 104 and supply device 138. Fiber material storage 106 may be coupled to machine 104 and/or supply device 138 to ensure fiber material storage 106 moves with machine 104 during the road resurfacing process. Alternatively, fiber material storage 106 may be formed integrally with supply device 138. In another non-limiting example, fiber material storage 106 may be positioned and coupled to a side of machine 104, such that fiber material storage 106 may be parallel with machine 104. In this non-limiting example, machine 104 and fiber material storage may move simultaneously and parallel to each other during the road resurfacing process discussed herein.

As shown in FIG. 1B, screed 142 may be positioned above existing road 102 a predetermined distance (D). The predetermined distance (D) may be dependent, at least in part, on the shape of the desired exposed surface formed from asphalt mixture 134, the amount of force and/or pressure to be applied to the asphalt mixture 134 during the road resurfacing process, the density or compactness of the asphalt mixture 134, the amount of asphalt mixture 134 supplied to existing road 102, the desired thickness of the exposed surface formed by asphalt mixture 134 during the road resurfacing process and so on. The predetermined distance (D) may be controlled and achieved by actuator 150 of system 100. Actuator 150 may be coupled to body 148 of machine 104 and screed 142 for substantially controlling and/or adjusting the distance between existing road 102 and screed 142 to the predetermined distance (D). In a non-limiting example shown in FIG. 1B, actuator 150 may be a hydraulic piston configured to move and/or adjust the position of screed 142, as discussed herein. In other non-limiting examples, actuator 150 may be formed from any suitable actuator component configured to adjust the position of screed 142 with respect to existing road 102 including, but not limited to, electrical actuators, hydraulic actuators, pneumatic actuators, magnetic actuators, mechanical actuators and so on.

System 100 may also include a control system 152. As shown in FIGS. 1A and 1B, control system 152 may be positioned on and/or coupled to machine 104 of system 100. Control system 152 may be in electrical communication with various components of system 100 utilized in the road resurfacing process discussed herein. Specifically, and as shown in FIG. 1B, control system 152 may be electrically coupled to and/or in electrical communication with various components of machine 104, including, but not limited to, first group of sprayers 108, second group of sprayers 110 fiber distribution component 124, cutting device 130, channel 132, hopper 136 and/or actuator 150. Additionally, control system 152 may be electrically coupled to and/or in electrical communication with fiber material storage 106 of system 100.

Control system 152 may be configured to control the function and/or operation of the various components of system 100 in which control system 152 may be in electrical communication. Specifically, control system 152 of system 100 may be configured to control the function and/or operation of first group of sprayers 108, second group of sprayers 110, fiber distribution component 124, cutting device 130, channel 132, hopper 136, actuator 150 and/or fiber material storage 106. In non-limiting examples, control system 152 may be configured to control the distribution (e.g., flow rate) of binding material 118 as it is dispensed over existing road 102 via first group of sprayers 108 and/or second group of sprayers 110. Additionally, control system 152 may be configured to control the distribution (e.g., density of fibers per area) of fiber material 126 distributed by fiber material distribution component 124 over the first layer of binding material 118. In a non-limiting example shown in FIG. 1B, control system 152 may be in electrical communication with cutting device 130 of fiber material distribution component 124. In the non-limiting example, control system 152 may also be configured to control the length at which fiber material 126 may be cut prior to being distributed by fiber material distribution component 124. Control system 152 may also be configured to control the distribution (e.g., feed/flow rate) of fiber material 126 provided from fiber material storage 106 to fiber material distribution component 124. In a non-limiting example, controlling the distribution of fiber material 126 from fiber material storage 106 to fiber material distribution component 124 may in turn also control the distribution of fiber material 126 distributed by fiber material distribution component 124, as discussed herein. Furthermore, control system 152 may be configured to control the distribution (e.g., flow rate, density of material per area) of asphalt mixture 134 supplied by channel 132 and disposed directly over the second layer of binding material, as discussed herein.

The distribution of the various materials deposited and/or supplied by the various components of system 100 may be based, at least in part, on specific, predetermined characteristics and/or properties of existing road 102, the desired finish of the resurfaced road and/or the characteristics of the material used by system 100 to form the resurfaced road. In non-limiting examples, the material composition of the existing road's 102 exposed surface, the condition (e.g., number of surface defects) of existing road 102, the age of existing road 102 and/or the grade of existing road may be some of the properties and/or characteristics that influence the distribution of the various materials utilized by system 100 and controlled by control system 152. In other non-limiting examples, the material composition of binding material 118 and asphalt mixture 134, the desired thickness of a top layer formed by asphalt mixture 134, and/or the desired additional strength to be provided to the resurfaced road via fiber material 124 may also influence the distribution of the various materials utilized by system 100 and controlled by control system 152. It is understood that the predetermined characteristics and/or properties that influence the distribution of the various materials utilized by system 100 are merely exemplary and are not meant to be exhaustive. Other such predetermined characteristics and/or properties may also influence the distribution of the various materials utilized by system 100.

Control system 152 may be formed as, or a part of, a user-interactive or automated computer or computing system for controlling the function and/or operation of the various components of system 100, as discussed herein. Specifically, control system 152 may be included within a computing system or device that can control the function and/or operation of the various components of system 100 to perform the road resurfacing process discussed herein. The computing system or device may include one or more general purpose computing articles of manufacture (e.g., computing devices) capable of executing program code, such as control system 152, installed thereon. Although not shown, computing system or device including control system 152 may include a processing component (e.g., one or more processors), a storage component (e.g., a storage hierarchy), an input/output (I/O) component (e.g., one or more I/O interfaces and/or devices), and a communications pathway. In general, the processing component executes program code, such as that of control system 152 configured to control the function and/or operation of the various components of system 100, which is at least partially fixed in the storage component. While executing program code, the processing component can process data, which can result in reading and/or writing transformed data from/to the storage component and/or the I/O component for further processing. The pathway provides a communications link between each of the components in the computing device. The I/O component can include one or more human I/O devices, which enable a user (e.g., machine 104 operator) to interact with the computing device and/or one or more communications devices to enable the user to communicate with the computing device using any type of communications link. In some embodiments, the user (e.g., machine 104 operator) can interact with a human-machine interface, which allows the user to communicate with control system 152 of the computing device. The human-machine interface can include: an interactive touch screen, a graphical user display or any other suitable human-machine interface. The computing system may also include a number of sensors positioned on each of the various components of system 100. The sensors may be configured to monitor the distribution of the materials by system 100, and provide data and/or feedback to the computing system including control system 152. In a non-limiting example the computing system and/or control system 152 may obtain and analyze this data and/or feedback from the sensors of the computing system, and may adjust the distribution of the various components of system 100 accordingly.

Although discussed herein as being controlled using control system 152, it is understood that operation and/or function of machine 104 and/or the various components of system 100 may be controlled and/or modified manually. For example, it is understood that the distribution (e.g., flow rate) of binding material 118 from first group of sprayers 108 may be modified and/or controlled by manually adjusting the sprayer components of first group of sprayers 108. Additionally, the operation and/or function of machine 104 and/or the various components of system 100 may be controlled and/or modified using both control system 152 and manual adjustments to ensure the resurfaced road formed by system 100 meets desired specifications.

Figure 2:
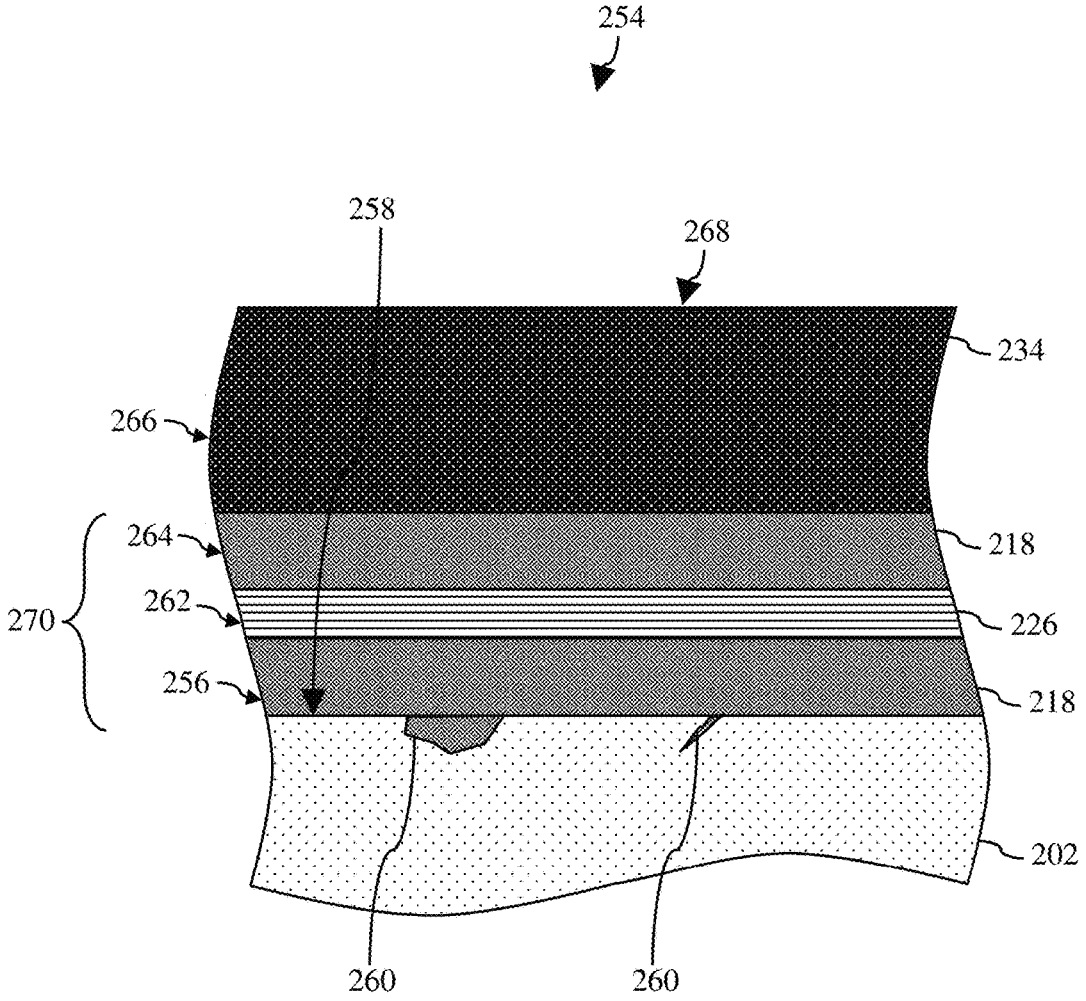
FIG. 2 depicts a side view of a portion of a resurfaced road using the road resurfacing system shown in FIGS. 1A and 1B, according to embodiments.

FIG. 2 shows a side view of a portion of a resurfaced road 254, according to embodiments. With continued reference to FIG. 1B, the various portions of resurfaced road 254 and the formation of resurfaced road 254 may now be discussed in detail. It is understood that similarly named components or similarly numbered components may function in a substantially similar fashion, may include similar materials and/or may include similar interactions with other components. Redundant explanation of these components has been omitted for clarity.

As shown in FIG. 2, a first layer 256 of binding material 218 may be disposed over existing road 202. Specifically, first layer 256 of binding material 218 may be disposed over and covers an exposed surface 258 of existing road 202.

Binding material 218 forming first layer 256 of resurfaced road 254 may be bonded to exposed surface 258 of existing road 202. Additionally, as shown in the non-limiting example of FIG. 2, binding material 218 forming first layer 256 may also be disposed in and/or substantially fill surface defects 260 (e.g., cracks, divots, pot holes and so on) of existing road 202 to substantially seal exposed surface 258 and/or existing road 202. In order to achieve the bonding, filling and/or sealing of existing road 202, binding material 218 forming first layer 256 of resurfaced road 254 may be formed from materials and/or material compositions having specific predetermined characteristics and/or properties. The predetermined characteristics and/or properties of binding material 218 may include, but are not limited to, substantially adhesive properties, substantially elastic properties, substantially impermeable properties and time/temperature-based curing properties. In a non-limiting example, binding material 218 forming first layer 256 of resurfaced road 254 may be formed from polymer modified asphalt emulsion. In other non-limiting examples, binding material 218 may be formed from other materials including, but not limited to, asphalt cement, polymer material, polymer modified asphalt cement and the like. With reference to FIG. 1B, and as discussed herein, first group of sprayers 108 in machine 104 may deposit and/or form first layer 256 of binding material 218.

Resurfaced road 254 may also include a layer or collection 262 of fiber material 226 disposed over first layer 256 of binding material 218. That is, collection 262 if fiber material 226 may be disposed, at least partially, over and/or may substantially cover first layer 256 of binding material 218. Fiber material 226 disposed over first layer 256 of binding material 218 may be embedded into binding material 218. Specifically, because of the adhesive, elastic and/or curing properties of binding material 218, forming first layer 256 of resurfaced road 256, collection 262 of fiber material 226 disposed over first layer 256 of binding material 218 may be embedded and/or adhered to binding material 218. Fiber material 226 forming collection 262 of resurfaced road 254 may include fiber material that may be cut to a predetermined length prior to being disposed over first layer 256 of binding material 218. In a non-limiting example, collection 262 of fiber material 226 includes fiberglass material that is capable of being cut to a predetermined length. Briefly returning to FIG. 1B, and as discussed above, fiber material distribution component 124 and/or cutting device 130 of machine 104 may cut, deposit and/or dispose fiber material 226 to form collection 262 of fiber material 226 in resurfaced road 254.

As shown in FIG. 2, a second layer 264 of binding material 218 may be disposed over collection 262 of fiber material 226. Specifically, second layer 264 of binding material 218 may cover collection 262 of fiber material 226, and may secure and/or sandwich collection 262 of fiber material 226 between first layer 256 of binding material 218 and second layer 264 of binding material 218. Binding material 218 forming second layer 264 of resurfaced road 254 may be substantially similar to binding material 218 forming first layer 256. As such, second layer 264 may have substantially similar characteristics, properties and/or material composition as first layer 256. In a non-limiting example, and similar to first layer 256, the adhesive, elastic and/or curing properties of binding material 218 forming second layer 264 allow collection 262 of fiber material 226 disposed over first layer 256 to be embedded and/or adhered to binding material 218 forming second layer 264 as well. As discussed herein and shown in FIG. 1B, second group of sprayers 110 in machine 104 may deposit and/or form second layer 264 of binding material 218.

Resurfaced road 254 may also include a top layer 266 of asphalt mixture 234 positioned on second layer 264 of binding material 218. More specifically, and as shown in FIG. 2, asphalt mixture 234 forming top layer 266 may be positioned and/or disposed directly on and may cover second layer 264 of binding material 218. Asphalt mixture 234 forming top layer 266 may be positioned directly on second layer 264 and may be embedded and/or bonded to binding material 218 forming second layer 264. Similar to the way in which first layer 256 of binding material 218 may be bonded to existing road 202 and/or similar to how collection 262 of fiber material 226 may be embedded into first layer 256, asphalt mixture 234 may be embedded in and/or bonded to second layer 264 of binding material 218. Embedding and/or bonding asphalt mixture 234 within second layer 264 of binding material 218 may be achieved as a result of the adhesive, elastic and/or curing properties of binding material 218 forming second layer 264.

Additionally, embedding and/or bonding asphalt mixture 234 may be achieved when asphalt mixture 234 is shaped to form top layer 266. More specifically, asphalt mixture 234 may be subject to and/or experiences an applied pressure or force to substantially shape and/or form asphalt mixture 234 into a substantially compact and substantially flat top layer 266 of resurfaced road 254. The applied pressure or force may embed asphalt mixture 234 at least partially into second layer 264 of binding material 218 and/or may bond asphalt mixture with second layer 264. Top layer 266 formed by shaped asphalt mixture 234 may include a newly exposed driving surface 268 to be driven on by users of resurfaced road 254. As discussed herein, asphalt mixture 234 may be formed from a composition of binding material 218 and aggregate. In non-limiting examples, asphalt mixture 234 may be formed from and/or may be a composition of aggregate (e.g., sized stone material) and binding material 218 including, but not limited to, asphalt emulsion, asphalt cement, polymer material, polymer modified asphalt cement and the like. Briefly returning to FIG. 1B, and as discussed above, asphalt mixture 234 may be deposited directly onto second layer 264 of binding material 218 using channel 132 and hopper 136, and may be shaped to form top layer 266 of resurfaced road 254 using screed 142 of machine 104.

First layer 256 of binding material 218, collection 262 of fiber material 226 and second layer 264 of binding material 218 may be collectively referred to as stress absorbing membrane interlayers 270 (hereafter, "SAMIs 266") of resurfaced road 254. As shown in FIG. 2 and discussed herein, SAMIs 270 may not be exposed and may be substantially covered by top layer 266 of asphalt mixture 234. As a result of the material composition of the various layers forming SAMIs 270, SAMIs 270 may mitigate and/or reduce the risk of reflective cracking occurring in resurfaced road 254, which in turn may increase the operational/drivable life of resurfaced road 254. For example, the elastic properties and/or substantially impermeable properties of binding material 218 forming first layer 256 and second layer 264 may allow SAMIs 270 to be substantially flexible. This flexibility allows for stress disbursement through SAMIs 270 when resurfaced road 254 is driven on, which in turn reduces wear and tear to resurfaced road 254. Additionally, the flexible and/or elastic properties of binding material 218 forming first layer 256 and second layer 264 may allow SAMIs 270 and/or resurfaced road 254 to compensation for expansion and/or contraction of resurfaced road 254 (including existing road 202) when resurfaced road 254 is exposed to extreme heat and/or cold.

Additionally, the collection 262 of fiber material 226 may provide added flexibility and strength to SAMIs 270 and/or resurfaced road 254. Specifically, fiber material 226 (e.g., fiber glass) forming collection 262 positioned between first layer 256 and second layer 264 of binding material 218 may improve the tensile strength and flexibility of SAMIs 270 and/or resurfaced road 254 due to the physical and material characteristics of fiber material 226. Like binding material 218 forming first layer 256 and second layer 264, collection 262 of fiber material 226 may improve the operational/drivable life of resurfaced road 254 by preventing and/or mitigating reflective cracking.

Figure 3:
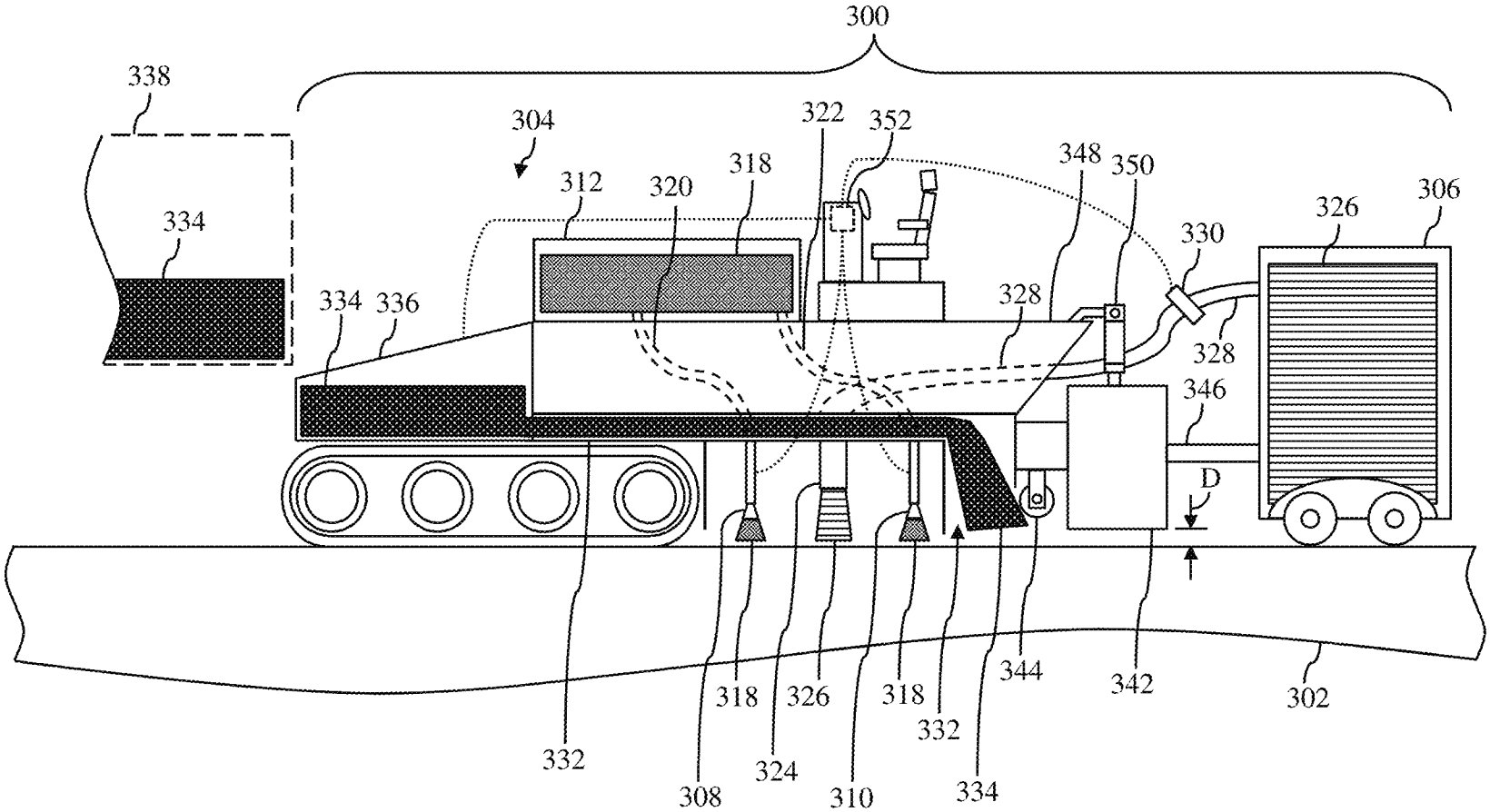
FIG. 3 depicts a schematic cross-sectional side view of the road resurfacing system of FIG. 1A taken along line CS-CS, according to additional embodiments.

FIG. 3 shows a side cross-sectional view of road resurfacing system 300 taken along line CS-CS in FIG. 1A, according to another embodiment. System 300 may be substantially similar to system 100 discussed herein with respect to FIGS. 1A and 1B. It is understood that similarly named components or similarly numbered components may function in a substantially similar fashion, may include similar materials and/or may include similar interactions with other components. Redundant explanation of these components has been omitted for clarity.

However, distinct from system 100 shown and discussed herein with respect to FIGS. 1A and 1B, system 300 shown in FIG. 3 includes cutting device 330 positioned between fiber material distribution component 324 and fiber material storage 306. Specifically, the cutting device 330 of system 300 may be positioned on, within and/or in communication with the plurality of supply lines 328. In a non-limiting example, cutting device 330 may positioned directly within the plurality of supply lines 328 where each supply line 328 may be a continuous, single supply line coupling fiber material storage 306 to fiber material distribution component 324. In another non-limiting example, cutting device 330 may be positioned between and/or couple two distinct sets of lines forming supply lines 328 of system 300, where a first set of supply lines are coupled to fiber material distribution component 324 and cutting device 330, and a second set of supply lines are coupled to cutting device 330 and fiber material storage 306. In the non-limiting example shown in FIG. 3, fiber material 326 may be cut to the predetermined length within supply lines 328, and then subsequently provided to fiber material distribution component 324. As discussed herein, auxiliary components (e.g., blowers) may be used to move and/or aid in moving the cut fibers of fiber material 326 from cutting device 330 to fiber material distribution component 324.

Figure 4:
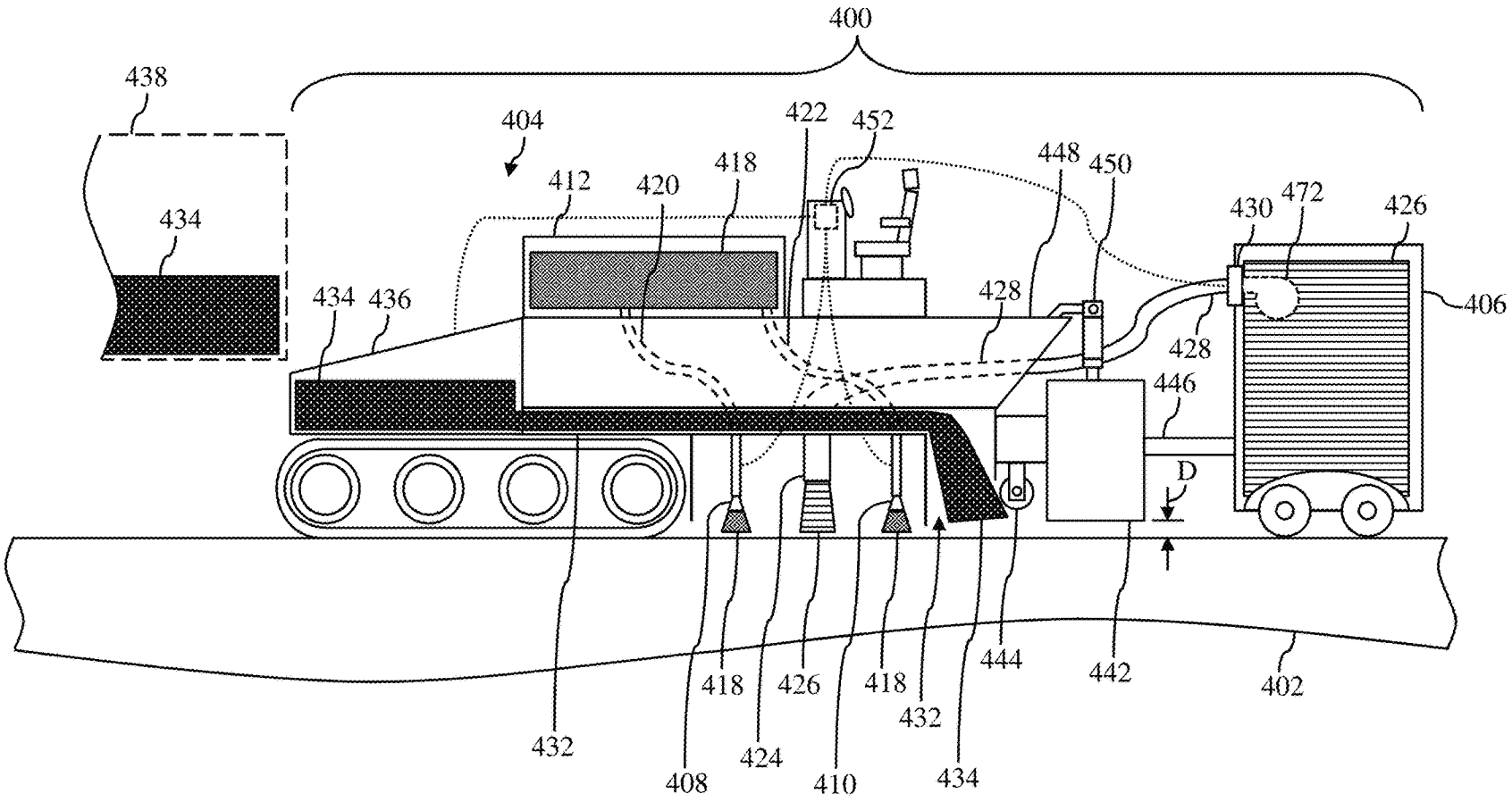
FIG. 4 depicts a schematic cross-sectional side view of the road resurfacing system of FIG. 1A taken along line CS-CS, according to further embodiments.

FIG. 4 shows a side cross-sectional view of road resurfacing system 400 taken along line CS-CS in FIG. 1A, according to a further embodiment. System 400 may be substantially similar to system 100 discussed herein with respect to FIGS. 1A and 1B. Distinct from system 100 of FIGS. 1A and 1B, system 400 may include cutting device 430 positioned substantially within fiber material storage 406. As shown in FIG. 4, cutting device 430 may be positioned within fiber material storage 406 and may be in communication with the plurality of supply lines 428 and fiber material 426 stored and/or positioned within fiber material storage 406. Cutting device 430 may be coupled to and/or in direct communication with the plurality of supply lines 428 of system 400, such that fiber material 426 may be cut to a predetermined length within fiber material storage 406 before being provided to supply lines 428 and fiber material distribution component 424.

To aid in the movement of the cut fiber material 426 from fiber material storage 406 and/or within supply lines 428, system 400 may also include a blower 472, shown in phantom. Blower 472 may be configured to move, blow, aid and/or force the cut fiber material 426 into and/or through supply lines 428 for being deposited by fiber material distribution component 424 onto and/or over existing road 402. In a non-limiting example shown in FIG. 4, blower 472 may be positioned within fiber material storage 406, and may be in communication with and positioned downstream from cutting device 430. In another non-limiting example, blower 472 may be positioned upstream from cutting device 430 and may be in communication with cutting device 430 and the plurality of supply lines 428. In another non-limiting example, blower 472 may be positioned within and/or in communication with only the plurality of supply lines 428, and may be positioned between fiber material distribution component 424 and fiber material storage 406.

In another non-limiting example, fiber material 426 may be pre-cut. More specifically, fiber material 426 stored in fiber material storage 406 may not be formed from a large spool or continuous fiber material, but rather, fiber material 426 may be pre-cut to the predetermined size and then stored in fiber material storage 406 for use by system 400 for resurfacing existing road 402, as discussed herein. In this non-limiting example where fiber material 426 is pre-cut, system 400 may not need cutting device 430. As a result, cutting device 430 may not be present and/or may not function as a cutter in system 400 that utilizes pre-cut fiber material 426. Additionally, and as discussed herein, system 400 utilizing pre-cut fiber material 426 may utilized blower 472 to aid in the movement of pre-cut fiber material 426 from fiber material storage 406 to fiber material distribution component 424.

Figure 5:
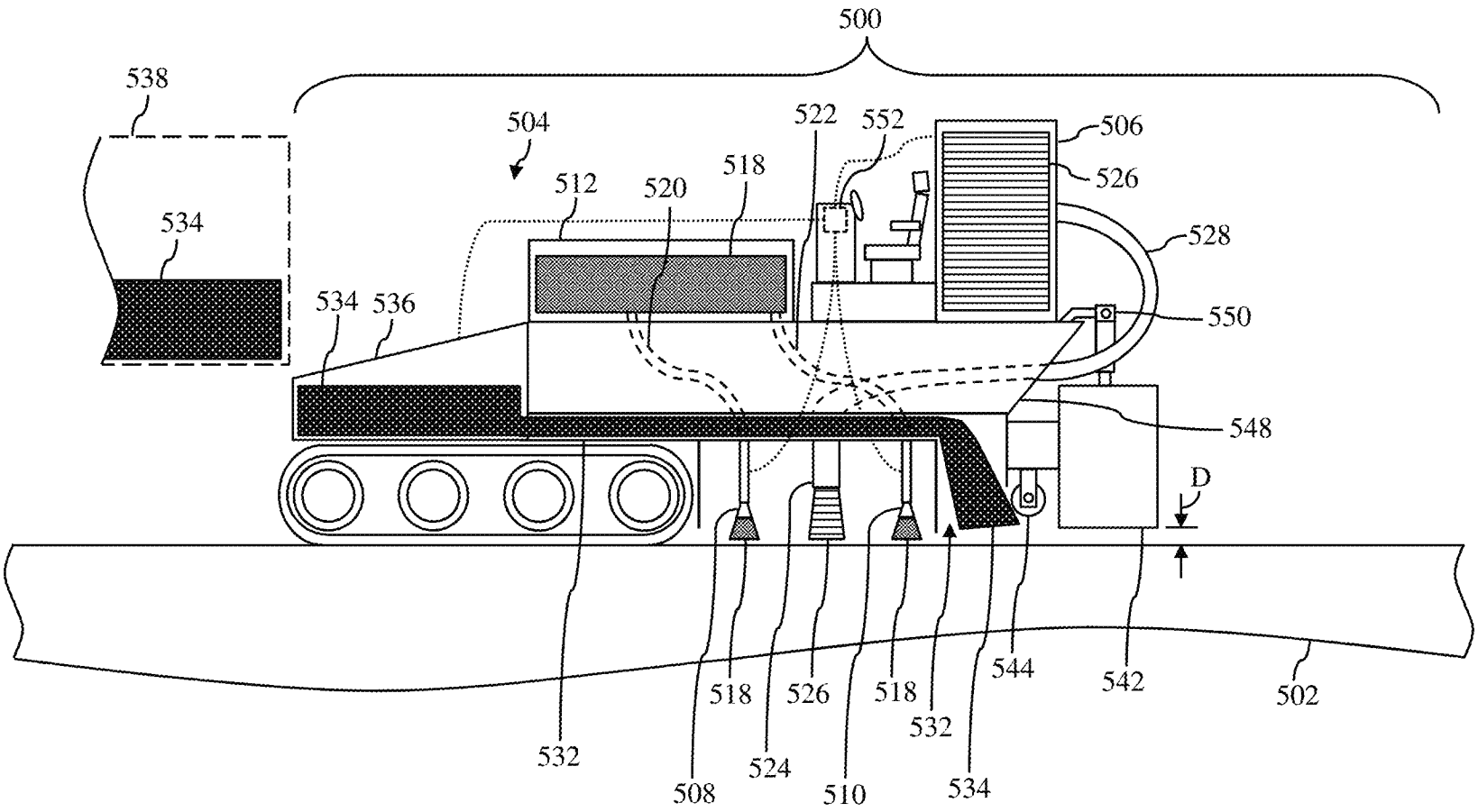
FIG. 5 depicts a schematic cross-sectional side view of the road resurfacing system of FIG. 1A taken along line CS-CS, according to another embodiment.

FIG. 5 shows a side cross-sectional view of road resurfacing system 500 taken along line CS-CS in FIG. 1A, according to another embodiment. System 500 may be substantially similar to system 100 discussed herein with respect to FIGS. 1A and 1B. Distinct from system 100 of FIGS. 1A and 1B, system 500 may include fiber material storage 506 positioned on machine body 548. More specifically, and as shown in FIG. 5, fiber material storage 506 containing fiber material 526 may be positioned directly on and/or may be directly coupled to machine body 548 such that fiber material storage 506 may move with machine 504 during the road resurfacing process discussed herein without the need of a coupling bar (see, FIG. 1B). Fiber material storage 506 may be formed integrally within machine body 548 of machine 504 or may be a distinct component coupled and/or fixed to machine 504 prior to performing the road resurfacing process.

In the non-limiting example shown in FIG. 5, and as similarly discussed herein, fiber material 526 may be supplied to fiber material distribution component 524 during the road resurfacing process. Fiber material 526 may be supplied to fiber material distribution component 524 using the plurality of supply lines 526 coupled to and positioned between fiber material storage 506 and fiber material distribution component 524. In the non-limiting example shown in FIG. 5, and as discussed herein, fiber material 526 may be pre-cut before being stored within fiber material storage 506 and being subsequently supplied to fiber material distribution component 524. In another non-limiting example, fiber material 526 may be cut prior to being supplied to fiber material distribution component 524 using a cutting device (see, FIG. 1B) positioned within and/or between fiber material storage 506 and fiber material distribution component 524.

Figure 6:
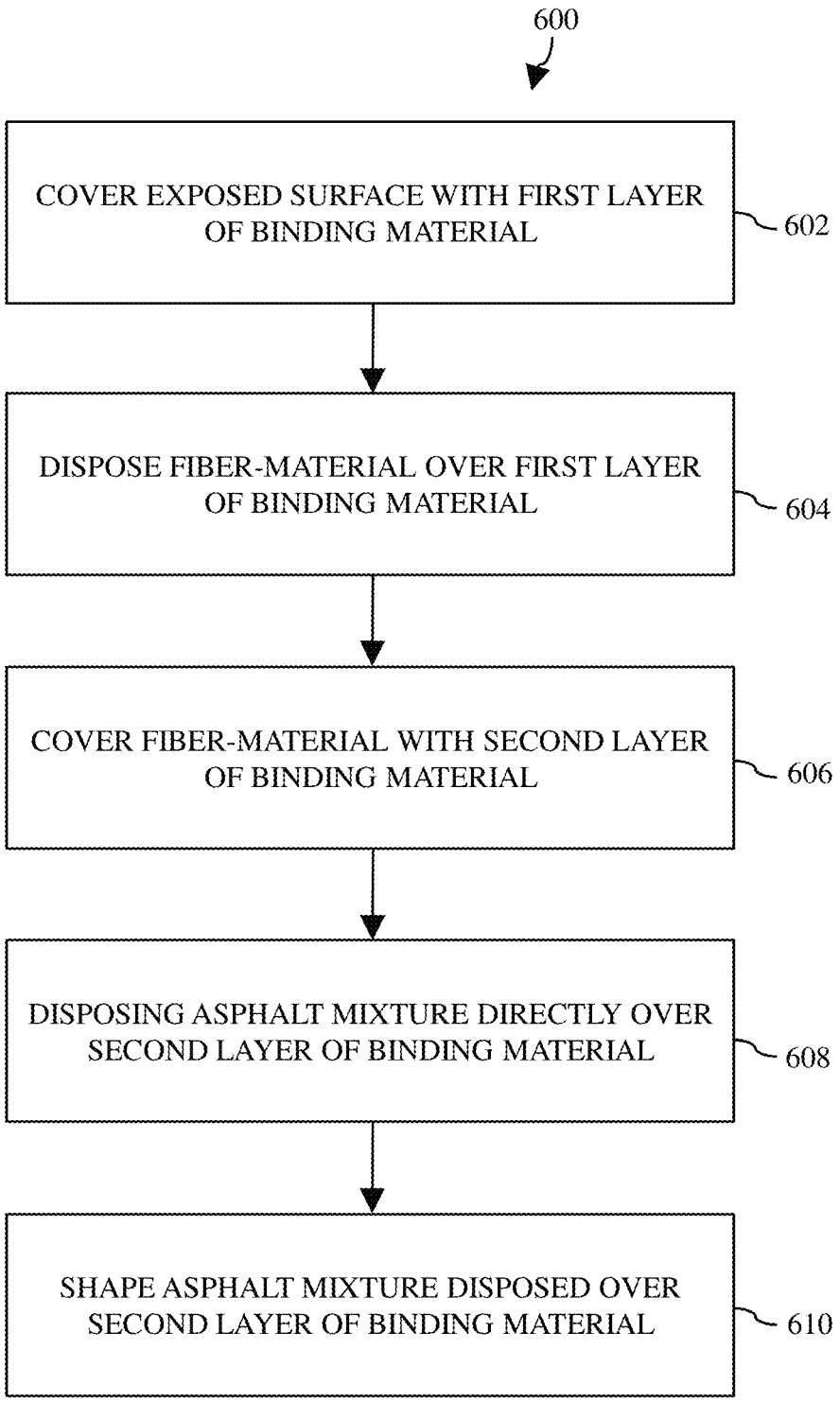
FIG. 6 depicts a flow chart illustrating a method for resurfacing an exposed surface of an existing road. This method can be performed using the road resurfacing systems shown in FIGS. 1A, 1B, and 3-5.

FIG. 6 depicts an example process for resurfacing an exposed surface. Specifically, FIG. 6 is a flowchart depicting one example process 600 for resurfacing an exposed surface of an existing road including surface defects. In some cases, a road resurfacing system may be used to form the resurfaced road, as discussed above with respect to FIGS. 1A, 1B, and 3-5.

In operation 602, the exposed surface of an existing road including surface defects may be covered with a first layer of binding material. More specifically, a first layer of binding material may be disposed over the existing road to cover the exposed surface of the existing road. Covering the exposed surface with the first layer of the binding material may also include bonding the first layer of the binding material to the exposed surface of the existing road. Additionally, covering the exposed surface with the first layer of the binding material may also include sealing the exposed surface of the existing road including surface defects. The sealing of the exposed surface of the existing road may further include filling surface defects formed in the exposed surface of the existing road with a portion of the binding material forming the first layer of the binding material.

In operation 604, a fiber material may be disposed at least partially over the first layer of the binding material. Specifically, a fiber material having a predetermined length is disposed and/or distributed over the first layer of the binding material. Disposing the fiber material at least partially over the first layer of the binding material includes securing, bonding, adhering and/or embedding the fiber material into the first layer of the binding material.

In operation 606, the fiber material may be covered with a second layer of binding material. More specifically, the fiber material embedded into and disposed over the first layer of the binding material may be covered by a second layer of binding material disposed over the fiber material. Covering the fiber material with the second layer of the binding material may include securing and/or sandwiching the fiber material between the first layer of the binding material covering the exposed surface of the existing road and the second layer of the binding material covering the fiber material.

In operation 608, an asphalt mixture may be disposed directly over the second layer of the binding material. More specifically, an asphalt mixture formed from a combination of asphalt emulsion (or asphalt cement) and aggregate may be disposed, deposited and/or cover the second layer of the binding material covering the fiber material and the first layer of the binding material, respectively. Disposing the asphalt mixture directly over the second layer of the binding material may also include bonding the asphalt mixture to the second layer of the binding material. Additionally, disposing the asphalt mixture directly over the second layer of the binding material may include embedding the asphalt mixture into the second layer of the binding layer.

In operation 610, the asphalt mixture disposed over the second layer of the binding material may be shaped. Specifically, the asphalt mixture disposed directly over, bonded and embedded into the second layer of the binding material may be shaped to a desire finish to form a top, drivable layer of a resurfaced road. The shaping of the asphalt mixture disposed over the second layer of the binding material may include pressing and/or applying a pressure or force to the asphalt mixture. The asphalt mixture may be pressed directly into the second layer of the binding material.

FIGS. 7A-7E show side views of existing road 702 undergoing the process 600 discussed herein with respect to FIG. 6. Specifically, FIGS. 7A-7E show existing road 702 going through the process 600 of resurfacing existing road 702 including surface defects 760 formed in exposed surface 758 (see, FIG. 7A). Each operation of process 600 shown in FIGS. 7A-7E may, for example, be performed using the road resurfacing system 100 and/or road resurfacing machine 104, discussed herein with respect to FIGS. 1A and 1B.

Figure 7A:
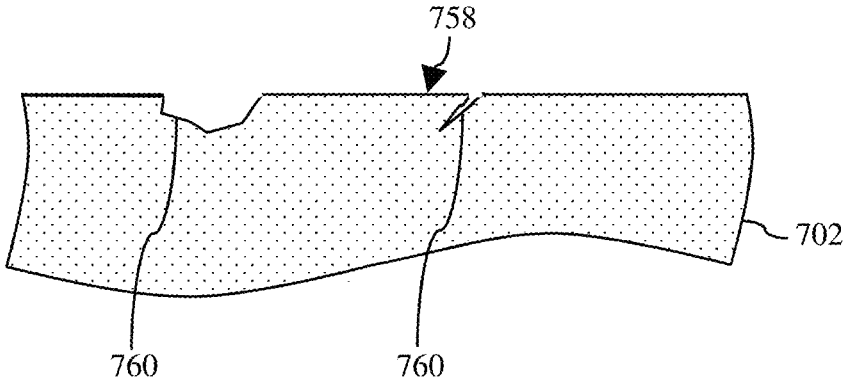
FIGS. 7A-7E depict an exposed surface of an existing road undergoing a resurface process. The exposed surface of the existing road can be resurfaces using the road resurfacing system shown in FIGS. 1A, 1B, and 3-5.
Figure 7B:
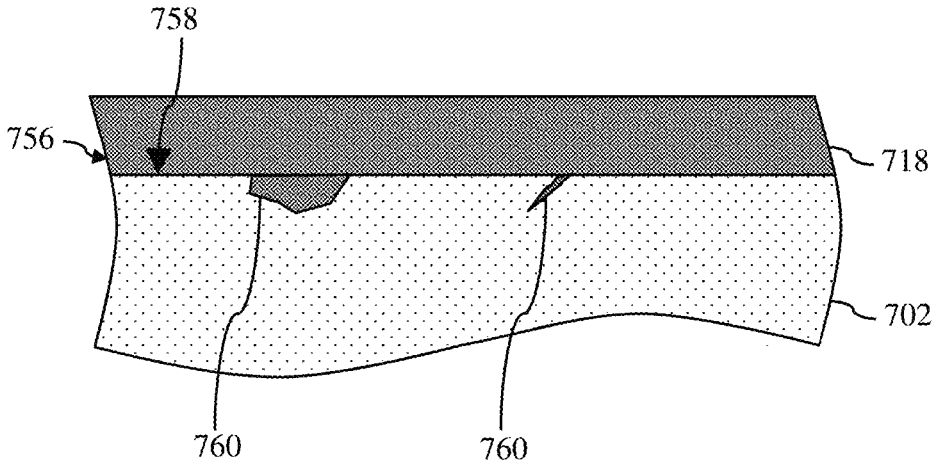

FIG. 7B shows exposed surface 758 of existing road 702 being covered by a first layer 756 of binding material 718. More specifically, first layer 756 of binding material 718 may cover and/or disposed over exposed surface 758 of existing road 702 including surface defects 760. In addition to covering exposed surface 758 and/or existing road 702, binding material 718 forming first layer 756 may be bonded to and/or may seal existing road 702. As shown in FIG. 7B, when covering, bonding to and/or sealing existing road 702, a portion of binding material 718 forming first layer 756 may be disposed in and/or may fill substantially all surface defects 760 formed in existing road 702 prior to performing the resurfacing process discussed herein. FIG. 7B may correspond to operation 602 of process 600 shown in FIG. 6.

Figure 7C:
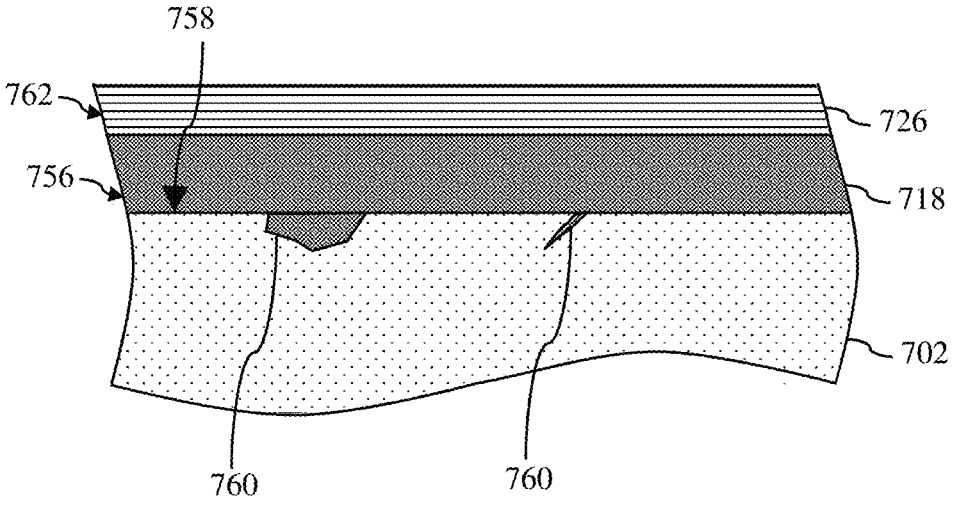

FIG. 7C shows first layer 656 of binding material 618 being covered by a collection 662 of fiber material 626. Specifically, collection 662 of fiber material 626 may cover, be distributed and/or be disposed over first layer 656 of binding material 618. Additionally, when collection 662 of fiber material 626 is disposed over first layer 656 of binding material 618, fiber material 626 may be secured, bonded, adhered and/or embedded into binding material 618 forming first layer 656. FIG. 7C may correspond to operation 604 of process 600 shown in FIG. 6.

Figure 7D:
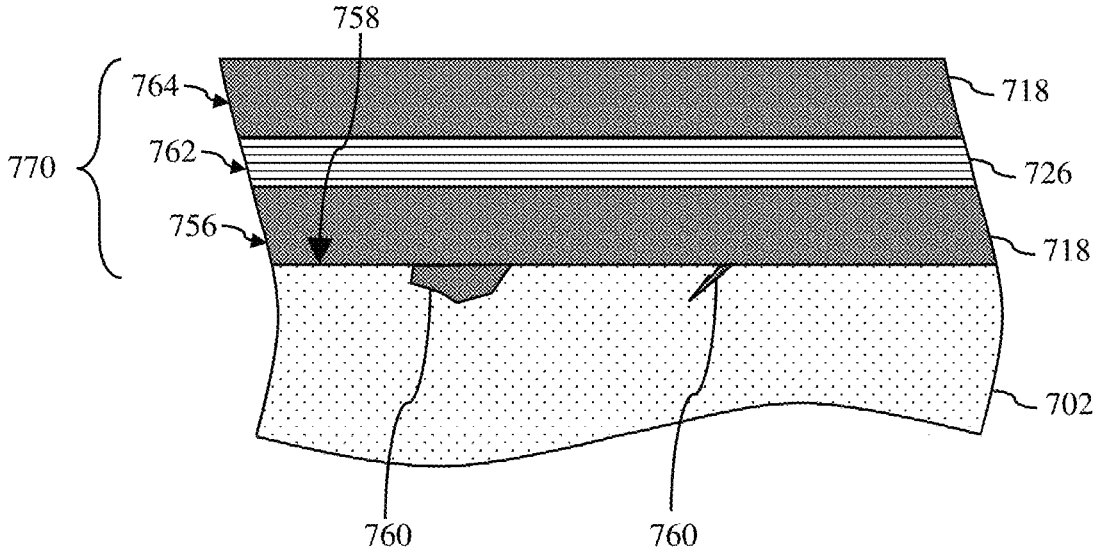

FIG. 7D shows collection 762 of fiber material 726 covered by second layer 764 of binding material 718. Specifically, second layer 764 of binding material 718 may be disposed over and/or cover collection 762 of fiber material 726 embedded and/or bonded to first layer 756 of binding material 718. Disposing and/or covering collection 762 of fiber material 726 with second layer 764 of binding material 718 may ensure collection 762 of fiber material 726 is secured and/or sandwiched between first layer 756 of binding material 718 and second layer 764 of binding material 718. Disposing and/or distributing second layer 764 of binding material 718 over collection 762 of fiber material 726 may also result in the formation of stress absorbing membrane interlayers 770 (hereafter, "SAMIs 670"). FIG. 7D may correspond to operation 606 of process 600 shown in FIG. 6.

Figure 7E:
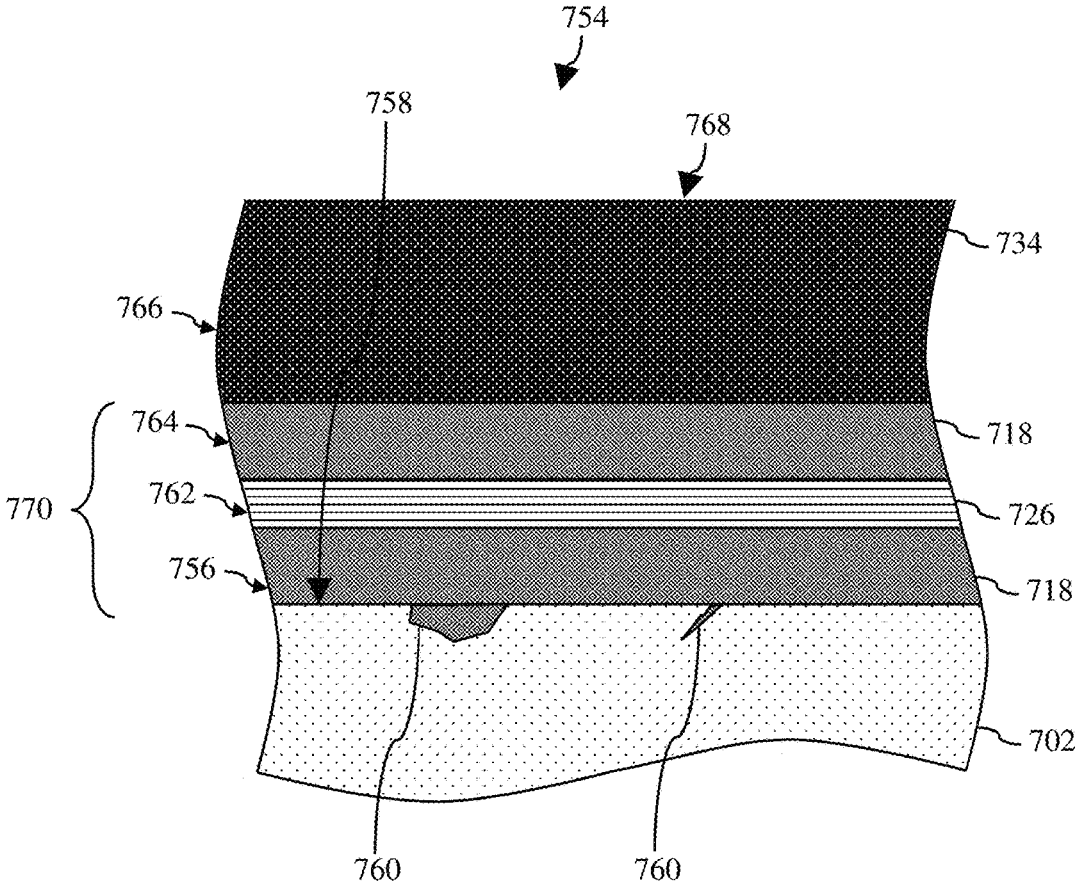

FIG. 7E shows asphalt mixture 734 being disposed directly over SAMIs 770. Specifically, asphalt mixture 734 may be disposed directly over, covers, is directly bonded to and/or may be embedded within second layer 764 of binding material 718. Once disposed directly over and/or covering second layer 764 of binding material 718, asphalt mixture 734 may be shaped to form top layer 766. Asphalt mixture 734 may be shaped, by pressing and/or applying a pressure or force to asphalt mixture 734, to a desire finish to form top, drivable layer 766 of resurfaced road 754. Top layer 766 of shaped, asphalt mixture 734 may form new, exposed driving surface for resurfaced road 754. FIG. 7E may correspond to operations 608 and 610 of process 600 shown in FIG. 6.

Illustrations with respect to one or more implementations, alterations and/or modifications can be made to the illustrated examples without departing from the spirit and scope of the appended claims. In addition, while a particular feature may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

As used herein, the term "configured," "configured to" and/or "configured for" can refer to specific-purpose features of the component so described. For example, a system or device configured to perform a function can include a computer system or computing device programmed or otherwise modified to perform that specific function. In other cases, program code stored on a computer-readable medium (e.g., storage medium), can be configured to cause at least one computing device to perform functions when that program code is executed on that computing device. In these cases, the arrangement of the program code triggers specific functions in the computing device upon execution. In other examples, a device configured to interact with and/or act upon other components can be specifically shaped and/or designed to effectively interact with and/or act upon those components. In some such circumstances, the device is configured to interact with another component because at least a portion of its shape complements at least a portion of the shape of that other component. In some circumstances, at least a portion of the device is sized to interact with at least a portion of that other component. The physical relationship (e.g., complementary, size-coincident, etc.) between the device and the other component can aid in performing a function, for example, displacement of one or more of the device or other component, engagement of one or more of the device or other component, etc.

In various embodiments, components described as being "coupled" to one another can be joined along one or more interfaces. In some embodiments, these interfaces can include junctions between distinct components, and in other cases, these interfaces can include a solidly and/or integrally formed interconnection. That is, in some cases, components that are "coupled" to one another can be simultaneously formed to define a single continuous member. However, in other embodiments, these coupled components can be formed as separate members and be subsequently joined through known processes (e.g., soldering, fastening, ultrasonic welding, bonding). In various embodiments, electronic components described as being "coupled" can be linked via conventional hard-wired and/or wireless means such that these electronic components can communicate data with one another.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings. Such modifications and variations that may be apparent to an individual in the art are included within the scope of the invention as defined by the accompanying claims.

I claim:

1. A system comprising:

a machine having:

a first group of sprayers configured to form a first layer of binding material;

a fiber material distribution component positioned adjacent the first group of sprayers, the fiber material distribution component configured to distribute fiber material onto the first layer of the binding material;

a second group of sprayers positioned adjacent the fiber material distribution component, the second group of sprayers configured to form a second layer of the binding material over the distributed fiber material;

a channel positioned adjacent the second group of sprayers, the channel configured to supply an asphalt mixture over the second layer of the binding material; and a screed positioned adjacent the channel, the screed positioned to contact the asphalt mixture;

fiber material storage coupled to the machine, the fiber material storage configured to store the fiber material distributed by the fiber material distribution component; and a control system in communication with the machine and the fiber material storage, the control system configured to control distribution of:

the binding material sprayed by the first group of sprayers;

the fiber material distributed by the fiber material distribution component;

the binding material sprayed by the second group of sprayers;

the asphalt mixture supplied by the channel; and the fiber material provided from the fiber material storage to the fiber material distribution component.

2. The system of claim 1 further comprising a plurality of supply lines coupled to the fiber material distribution component and the fiber material storage, the plurality of supply lines configured to supply the fiber material from the fiber material storage to the fiber material distribution component.

3. The system of claim 2 further comprising a cutting device for cutting the fiber material to a predetermined length prior to fiber material being distributed onto the second layer of the binding material.

4. The system of claim 3, wherein the cutting device is positioned between the fiber material distribution component and the fiber material storage.

5. The system of claim 3, wherein the cutting device is positioned within the fiber material storage.

6. The system of claim 1, wherein the fiber material in the fiber material storage is pre-cut.

7. The system of claim 1, wherein the fiber material storage is positioned on the machine.

8. The system of claim 1, wherein the machine further comprises:

binding material storage in fluid communication with:

the first group of sprayers; and the second group of sprayers.

9. The system of claim 8, wherein the machine further comprises:

a first conduit coupled to the binding material storage and the first group of sprayers; and a second conduit coupled to the binding material storage and the second group of sprayers.

10. The system of claim 1, wherein the fiber material distribution component of the machine is positioned between the first group of sprayers and the second group of sprayers.

11. The system of claim 1, wherein the channel of the machine is positioned between the second group of sprayers and the screed.

12. The system of claim 1, wherein the machine further comprises a hopper for receiving the asphalt mixture, the hopper in communication with the channel.

13. The system of claim 3, wherein the cutting device is formed integrally with the fiber material distribution component.

14. The system of claim 3, wherein the cutting device is positioned one of:

between the fiber material distribution component and the plurality of supply lines, or within the plurality of supply lines.

15. A machine comprising:

at least one group of sprayers configured to dispense a binding material;

a fiber material distribution component positioned adjacent the at least one group of sprayers, the fiber material distribution component configured to distribute fiber material;

a channel positioned downstream the at least one group of sprayers and the fiber material distribution component, the channel configured to supply an asphalt mixture over the dispensed binding material and the distributed fiber material;

a screed positioned adjacent the channel, the screed positioned to contact the asphalt mixture; and a control system in communication with:

the at least one group of sprayers, the fiber material distribution component, and the channel, wherein the control system is configured to control distribution of:

the binding material dispensed by the at least one group of sprayers;

the fiber material distributed by the fiber material distribution component; and the asphalt mixture supplied by the channel.

16. The machine of claim 15 further comprising fiber material storage in communication with the fiber material distribution component, the fiber material storage configured to store the fiber material distributed by the fiber material distribution component.

17. The machine of claim 16, wherein the control system is configured to control distribution of the fiber material provided from the fiber material storage to the fiber material distribution component.

18. A system comprising:

a machine including:

at least one group of sprayers configured to dispense a binding material;

a fiber material distribution component positioned adjacent the at least one group of sprayers, the fiber material distribution component configured to distribute fiber material;

a channel positioned downstream the at least one group of sprayers and the fiber material distribution component, the channel configured to supply an asphalt mixture over the dispensed binding material and the distributed fiber material; and a screed positioned adjacent the channel, the screed positioned to contact the asphalt mixture;

fiber material storage in communication with the fiber material distribution component, the fiber material storage configured to store the fiber material distributed by the fiber material distribution component; and a control system in communication with the machine and the fiber material storage, the control system configured to control distribution of:

the binding material dispensed by the at least one group of sprayers;

the fiber material distributed by the fiber material distribution component;

the asphalt mixture supplied by the channel; and the fiber material provided from the fiber material storage to the fiber material distribution component.

19. The system of claim 18, wherein the machine further comprises:

a plurality of supply lines coupled to the fiber material distribution component and a fiber material storage, the plurality of supply lines configured to supply the fiber material to the fiber material distribution component; and a binding material storage in fluid communication with the at least one group of sprayers.

20. The system of claim 18, wherein the at least one group of sprayers of the machine includes at least one of:

a first group of sprayers positioned adjacent and upstream of the fiber material distribution component, or a second group of sprayers positioned adjacent and downstream of the fiber material distribution component.

* * * * *